US008393194B2

(12) United States Patent
Nothnagel et al.

(10) Patent No.: US 8,393,194 B2
(45) Date of Patent: Mar. 12, 2013

(54) CRIMPING TOOL

(75) Inventors: Horst Nothnagel, Steinbach-Hallenberg (DE); Gerhard Koenig, Steinbach-Hallenberg (DE); Michael Brueckner, Steinbach-Hallenberg (DE); Thomas Wagner, Bermbach (DE)

(73) Assignee: Rennsteig Werkzeuge GmbH, Viernau (DE)

( * ) Notice: Subject to any disclaimer, the term of this patent is extended or adjusted under 35 U.S.C. 154(b) by 779 days.

(21) Appl. No.: 12/380,965

(22) Filed: Mar. 5, 2009

(65) Prior Publication Data

US 2009/0223274 A1 Sep. 10, 2009

(30) Foreign Application Priority Data

Mar. 7, 2008 (DE) ..... 10 2008 013 184

(51) Int. Cl.
*B21D 43/26* (2006.01)

(52) U.S. Cl. ..... 72/409.13; 72/409.01; 72/482.6; 72/482.91

(58) Field of Classification Search ..... 72/103, 72/104, 120, 121, 402, 409.01, 409.04, 409.08, 72/409.12, 409.13, 409.18, 433, 434, 482, 72/6, 482.91, 364, 409.1; 81/433, 434, 482.6, 81/482.91, 313, 367, 427; 29/280, 282
See application file for complete search history.

(56) References Cited

U.S. PATENT DOCUMENTS

| | | | | |
|---|---|---|---|---|
| 378,150 | A * | 2/1888 | Holmes et al. | 285/294.1 |
| 2,933,000 | A * | 4/1960 | Wood | 72/402 |
| 3,199,335 | A * | 8/1965 | Holmes et al. | 72/409.01 |
| 3,354,692 | A * | 11/1967 | Morris | 72/402 |
| 6,176,116 | B1 | 1/2001 | Wilhelm et al. | |
| 6,293,004 | B1 * | 9/2001 | Holliday | 29/751 |
| 7,797,979 | B2 * | 9/2010 | Beining et al. | 72/402 |
| 2010/0126946 | A1 * | 5/2010 | Morgan | 210/767 |

FOREIGN PATENT DOCUMENTS

| | | |
|---|---|---|
| EP | 0 732 779 | 9/1996 |

* cited by examiner

*Primary Examiner* — Edward Tolan
*Assistant Examiner* — Homer Boyer
(74) *Attorney, Agent, or Firm* — Collard & Roe, P.C.

(57) ABSTRACT

The invention relates to a crimping tool (1) having crimp indentors and a through-opening for the introduction of a cable end which is to be crimped, introduction of the cable end being limited by an adjustable stop part (2) which is fixedly connected to the crimping tool (1), but is preferably operationally releasable, furthermore, the stop part (2) having different stop pins (3) which can be selectively activated by being pushed down and, if a different stop pin (3) is selected, the activated stop pin (3), which is biased into its non-activated position, having to be released from the stop position. In order to provide a crimping tool with a stop part for which there is advantageous adjustment from one activated stop pin to another activated stop pin, it is proposed that the activated stop pin (3) is retained by a spring latching means formed by a retaining spring (6), and the spring latching means can be deactivated by a release movement of the stop part (2).

15 Claims, 6 Drawing Sheets

CRIMPING TOOL

CROSS REFERENCE TO RELATED APPLICATIONS

Applicants claim priority under 35 U.S.C. §119 of German Application No. 10 2008 013 184.9 filed on Mar. 7, 2008.

The invention relates to a crimping tool having crimp indentors and a through-opening for the introduction of a cable end which is to be crimped, introduction of the cable end being limited by an adjustable stop part which is fixedly connected to the crimping tool, but is preferably operationally releasable, furthermore, the stop part having different stop pins which can be selectively activated by being pushed down and, if a different stop pin is selected, the activated stop pin, which is biased into its non-activated position, having to be released from the stop position.

Various embodiments of such crimping tools are already known. Reference is made, for example, to EP 732779 B1.

In the case of a known crimping tool, in order to move the activated stop pin into its non-activated position, it is necessary to actuate a separate knob on the stop part, whereupon the activated stop pin springs back, under the abovementioned spring biasing, into its non-activated position. The stop part can then be rotated in order for a further stop pin to reach a position relative to the crimping tool which allows it to move into the activated position. This procedure is considered too complex.

Taking the cited prior art as a departure point, it is an object of the invention to provide a crimping tool having a stop part in the case of which it is possible to achieve advantageous adjustment from one activated stop pin to a further activated stop pin.

According to a first idea for a solution, this object is achieved by the subject matter of claim 1, by which it is provided that the activated stop pin is retained by a spring latching means formed by a retaining spring, and the spring latching means can be deactivated by a release movement of the stop part. Accordingly, a further spring is provided, this further spring acting on the stop pin in addition to the spring which biases the stop pin into its non-activated position. It is also provided that this spring, the retaining spring, can be deactivated by a release movement of the stop part. This accordingly gives rise to handling which makes it possible for the stop part as a whole merely to be raised—and then rotated—if another stop pin is to be activated. During the raising operation, the initially activated stop pin moves, at the same time, into its non-activated position. Once the rotary movement has been executed, and the stop part has been released again, and correspondingly engages against the crimping tool, a next stop pin can be moved out of its non-activated position into its activated position simply by being pushed down.

It is also an object of the invention to provide a crimping tool having a stop part which can react advantageously to the loads which occur during crimping.

According to a first idea for a solution, this object is achieved by the subject matter of claim 2, by which it is provided that a stop pin has a stop body, and that the stop body is mounted such that it can give way in a resilient manner in the stop direction in the stop pin. When a wire or the like which is to be crimped is inserted, the stop body can possibly give way in a resilient manner at least over a limited distance in the stop direction. This ensures that a wire is accommodated in an advantageous manner even under high loading.

In particular in respect of the initially explained idea, it is preferred if the release movement of the stop part can be effected in the direction in which the introduced cable end extends. For release purposes, the stop part thus has to be moved, relative to the crimping tool, transversely to the crimping plane. It is also preferred if, during the release movement, the stop part can be moved counter to spring biasing. The spring biasing otherwise retains the stop part in engagement against the crimping tool. A positive locking which, in the position in which the stop part engages against the crimping tool, acts against rotation is preferably provided in addition.

Furthermore, it is preferred if, during the release movement, the retaining spring can be spread apart in order to deactivate the spring latching means. Accordingly, for the purpose of deactivating the spring latching means of the activated stop pin, the retaining spring is deactivated in that it is flexed out—locally—in a resilient manner. This flexing-out or spreading apart takes place during, or as a result of, the release movement of the stop part.

Furthermore, it is preferred if the retaining spring extends in a plane running transversely to the release movement. Even if it can also basically extend in the direction in which a face, for example of the activated stop pin, is acted upon, and for example can be deactivated by sliding off the same during the release movement, it is preferred if the retaining spring extends at least to a significant extent, but preferably also to the full extent, in a plane running transversely to the release movement. It is preferred here if the retaining spring is spread apart, or deactivated, not by direct interaction with the activated stop pin, but by a separate spreading part. This spreading part may preferably be a connecting pin which forms part of the stop part and via which the latter is connected to the crimping tool. In this case, spreading apart can take place by interaction between the connecting pin and the retaining spring. The connecting pin has a spreading extension or, as such, spreads the retaining spring during the release movement of the stop part.

The interaction between the connecting pin and the retaining spring is provided for on the stop part, preferably in a radially offset manner in relation to a latching interaction between the retaining spring and the activated stop pin. Rather than engaging directly, the connection pin thus engages only indirectly in the latching connection between the retaining spring and the activated stop pin.

More specifically, it is preferred if the interaction of the retaining spring with the connecting pin is radially inward relative to the interaction with the stop pin. It is preferred here in addition, but not necessarily, for the stop part to be of at least substantially circular form or cylindrical form overall.

Furthermore, it is preferred if a single retaining spring is provided for all the stop pins of the stop part.

More specifically in respect of the stop body, which is accommodated in the stop pin and is mounted such that it can give way in a resilient manner in the stop direction, it is also preferably provided that the stop-body has a stop-body head, and that the stop body head interacts with a spring part. The capability to give way in a resilient manner results from the interaction with this spring part. More specifically, it is also preferred if the stop-body head forms a stop shoulder which interacts, in a direction counter to the stop direction, with a counter-stop formed in the interior of the stop pin. The counter-stop is the outermost boundary for the movement of the stop body counter to the stop direction. The stop body is normally located in the position which is defined by this stop shoulder.

The stop pin, further preferably, may have a gripping end. This is, in particular, preferably a knob-like end which is somewhat enlarged in diameter and, by having pressure applied to it, allows the stop pin as a whole to be displaced out of the non-activated position described into the activated position. Further preferably, this gripping end may be formed by a gripping part held in the stop pin. This means, in particular, a connection that is advantageous in production terms, for example by means of a press fit.

The invention will be explained in more detail hereinbelow with reference to the accompanying drawing, which however merely illustrates one exemplary embodiment. In the drawing.

Figure 1:
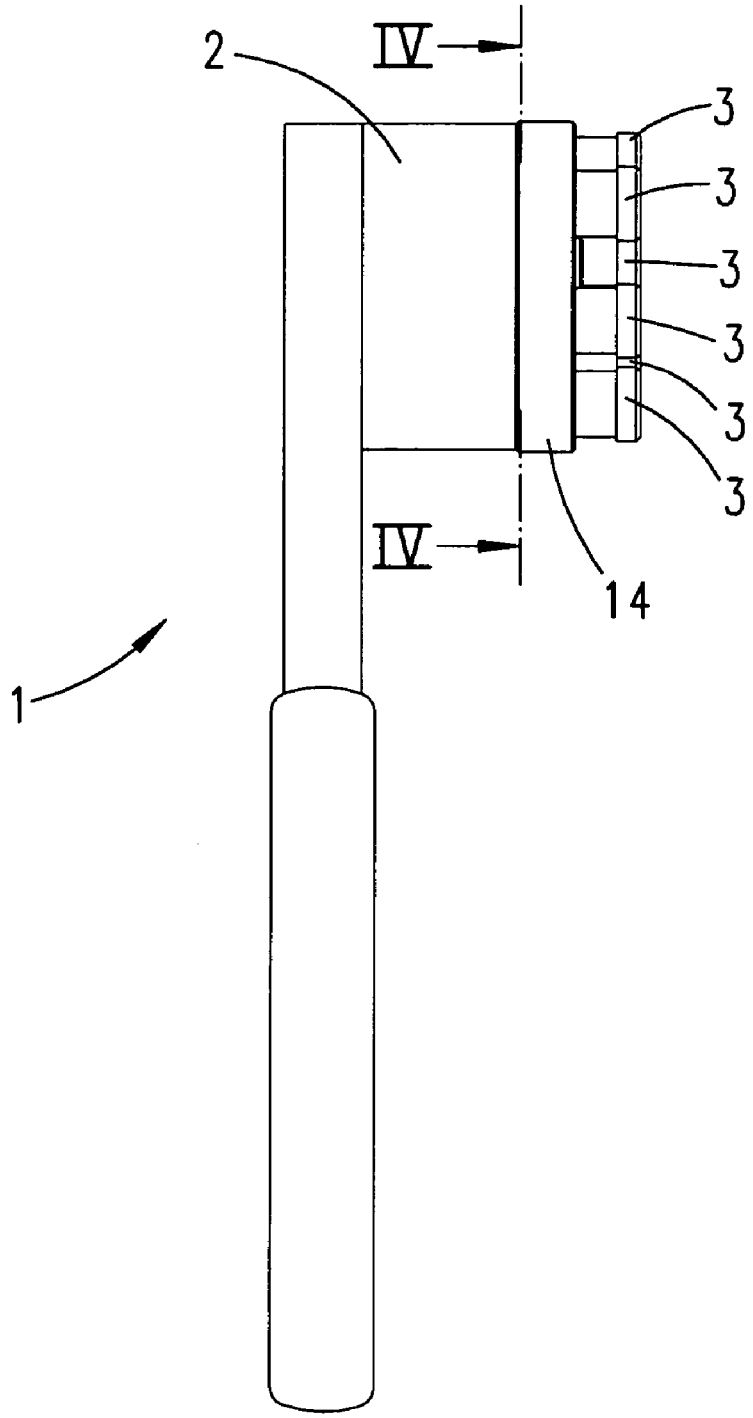
FIG. 1 shows, in side view, a crimping tool with stop part positioned thereon.

A crimping tool 1 with a stop part 2, which is arranged thereon and is also referred to as a locator, will be illustrated and described with reference to FIG. 1.

Although not illustrated specifically, the crimping tool also has crimp indentors and a through-opening for the introduction of a cable end which is to be crimped. The introduction of the cable end is limited by the stop part, the stop part, depending on the cable which is to be crimped, having different stop pins which can be brought selectively into an active position by the stop part being rotated and a stop pin 3 being pushed down. A pushed-down, activated stop pin 3 is under bias towards its non-activated position. This biasing is utilized in order, if a new stop pin 3 is to be brought into an active position, to displace the activated stop pin 3 into its non-activated position.

Figure 5:
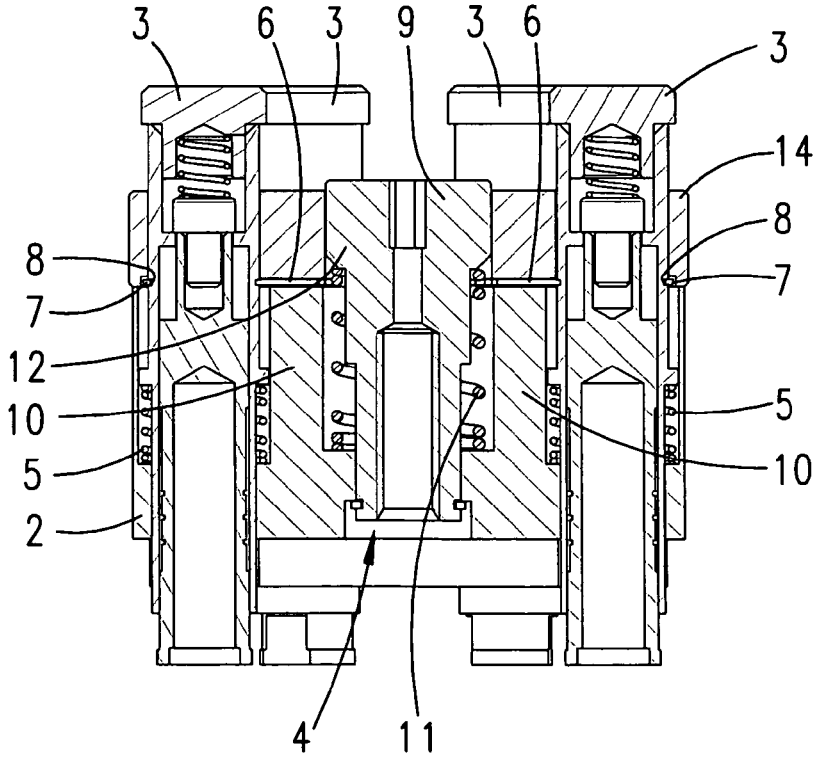
FIG. 5 shows a cross-section through the item according to FIG. 2, as seen along line V-V.
Figure 7:
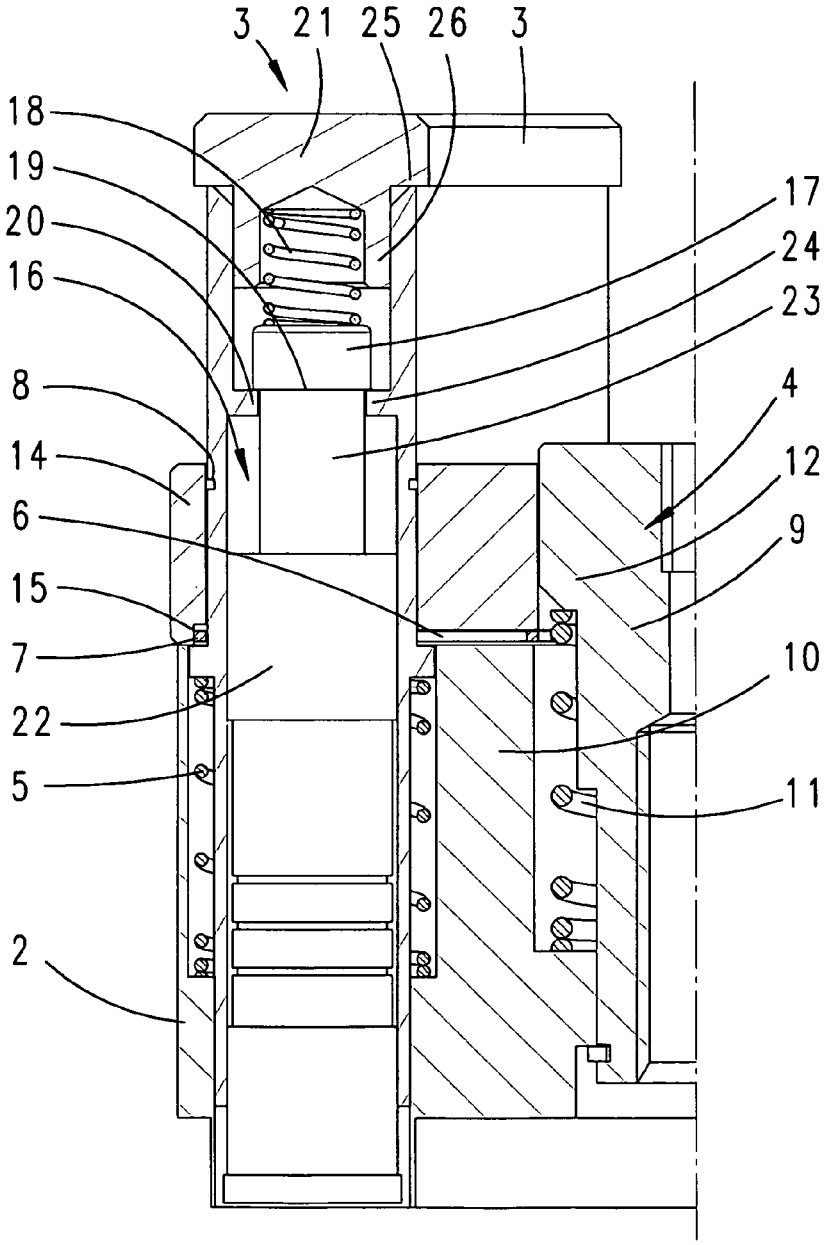
FIG. 7 shows a detail illustration corresponding to FIG. 5, with the stop pin in the non-activated position.
Figure 8:
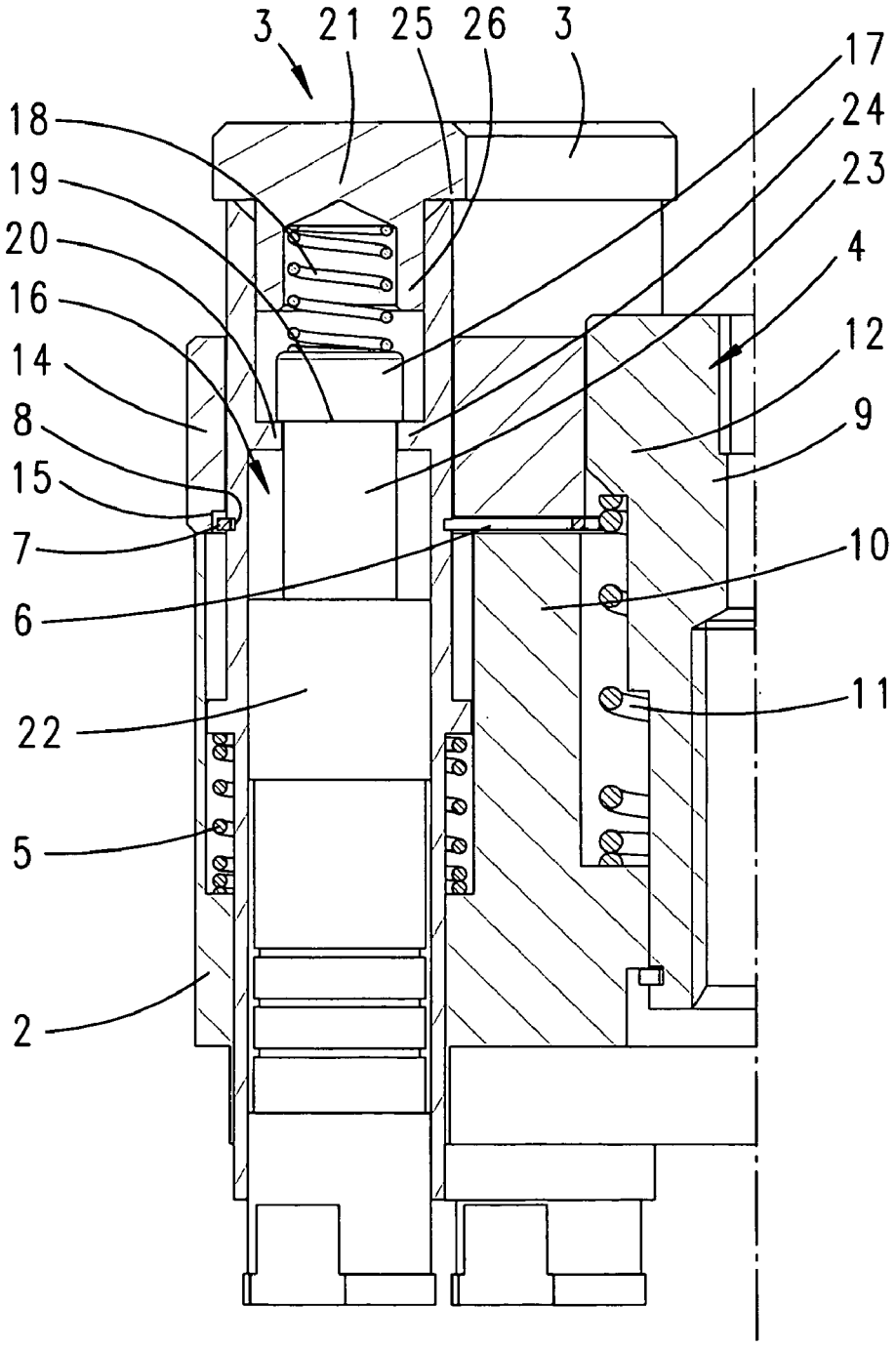
FIG. 8 shows an illustration according to FIG. 7, with the stop pin activated.

An activated stop pin is illustrated in FIGS. 5 and 8, and a non-activated stop pin 3 is illustrated in FIG. 7.

Figure 2:
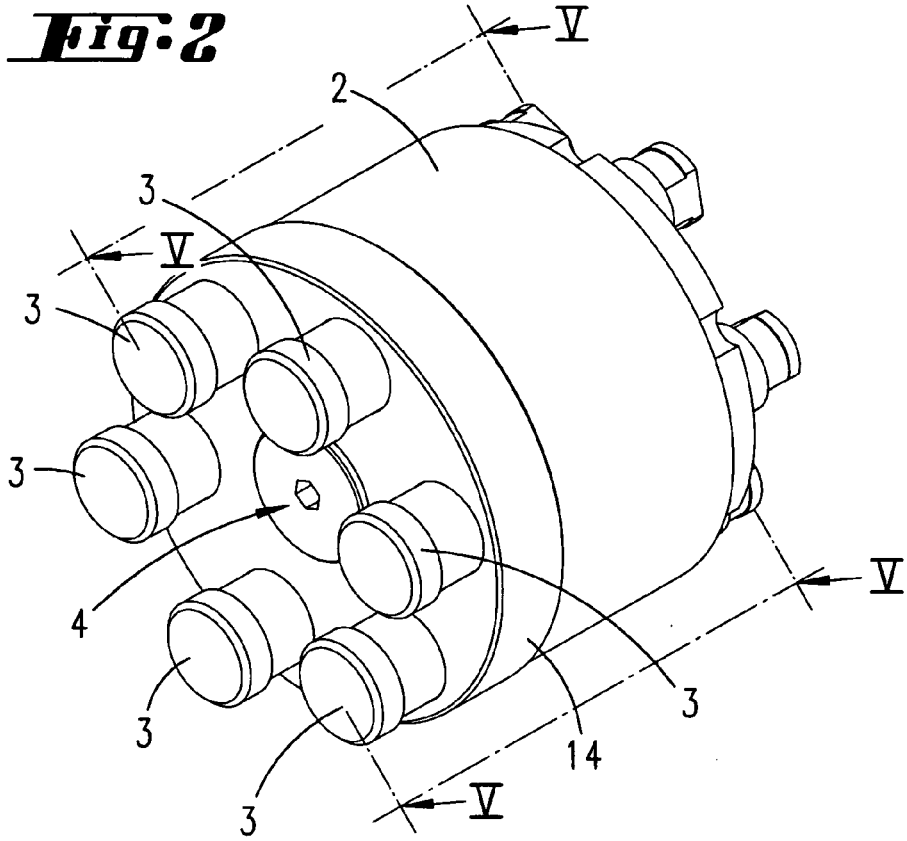
FIG. 2 shows a perspective view of the stop part on its own, as seen from the side on which the stop pins are pushed down.
Figure 3:
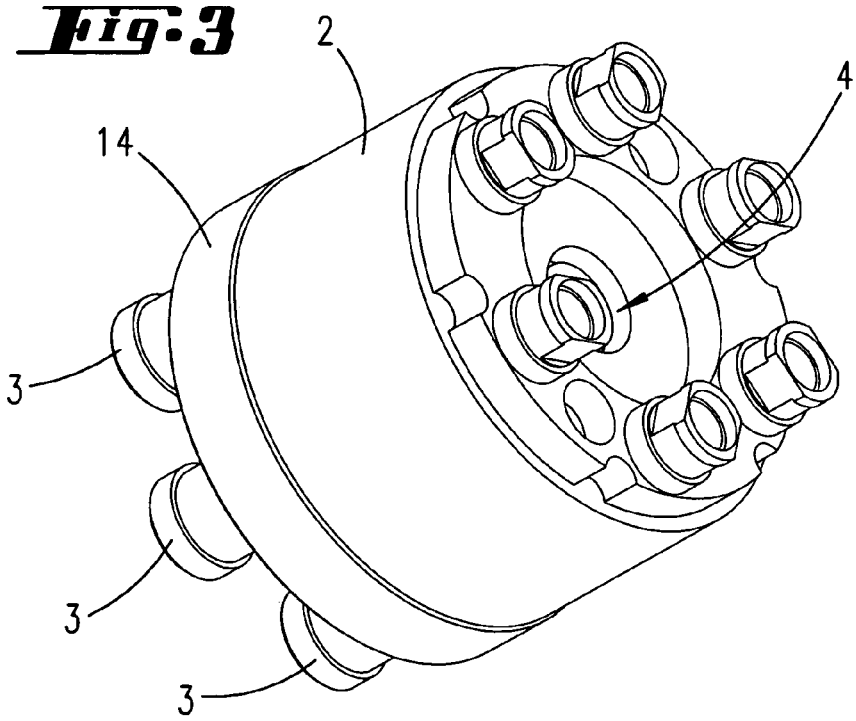
FIG. 3 shows a perspective view according to FIG. 2, but seen from the other side.
Figure 4:
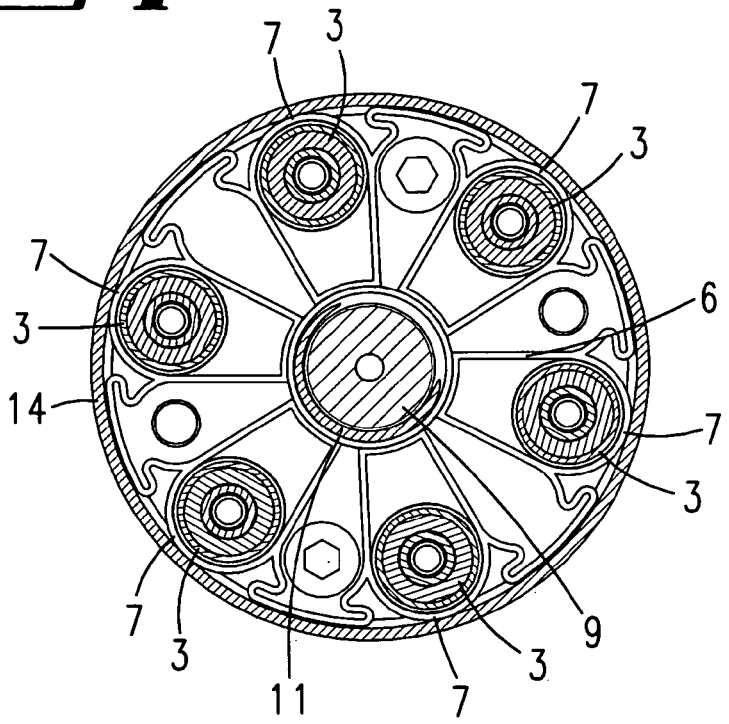
FIG. 4 shows a cross-section through the item according to FIG. 1, as seen along line IV-IV.

The stop part itself, as can be gathered from FIG. 2 to 4, is of substantially cylindrical and rotation-symmetrical construction. It has a central securing means 4, by means of which it can be secured to the crimping tool 1, for example by means of a screw. The securing here is such that, by virtue of the stop part 2 being rotated, the stop pins 3, which are disposed over an arc of a circle, can always be made to coincide with the through-opening of the crimping tool. Accordingly, the stop part 2 is mounted eccentrically in relation to the through-opening on the crimping tool 1.

Six stop pins 3 are provided in the case of the exemplary embodiment.

One stop pin 3 has been biased into its non-activated position by a compression spring 5 (see FIGS. 5, 7 and 8).

Figure 6:
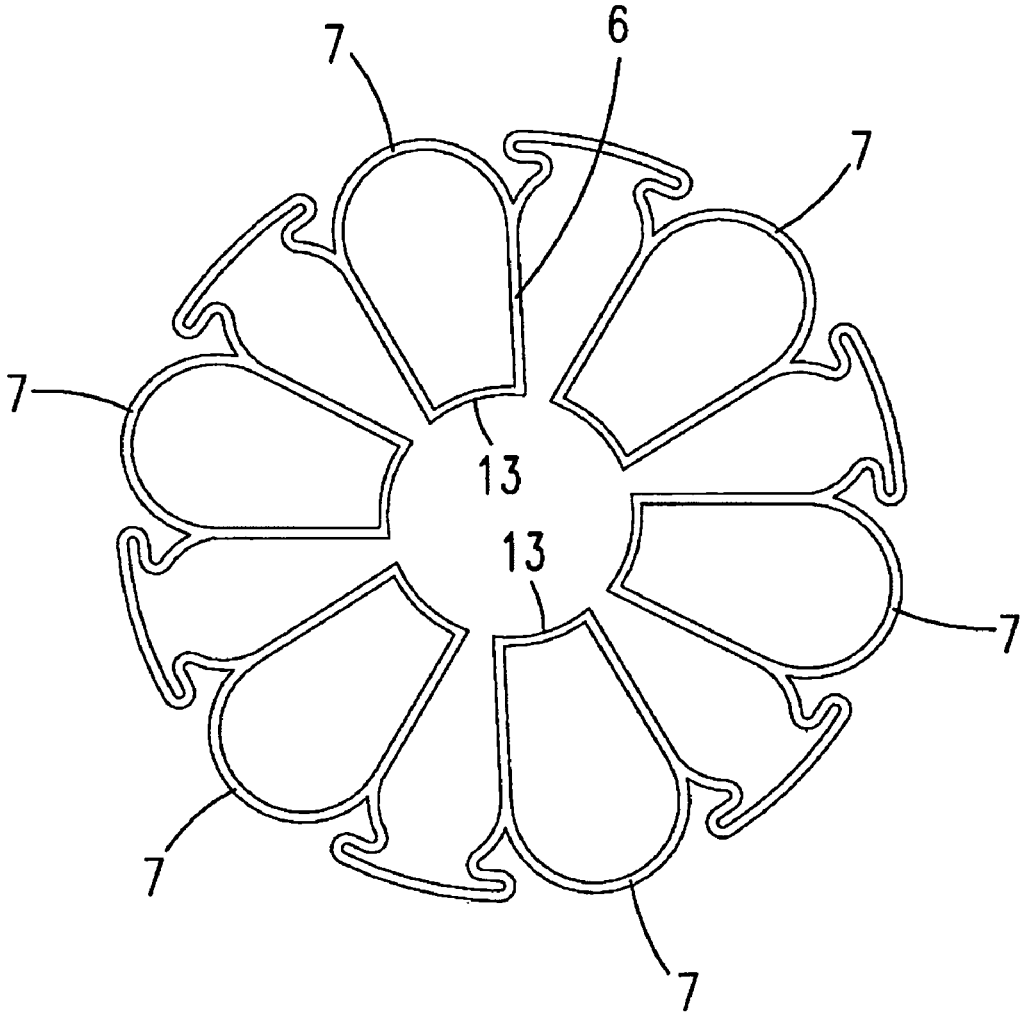
FIG. 6 shows a plan view of the retaining spring.

Also provided is a retaining spring 6, cf., in particular, FIG. 6, which, in the case of the exemplary embodiment, is disposed in a plane transverse to the direction in which a stop pin 3 is pushed down. The retaining spring 6 has a plurality of regions of interaction 7, in which it interacts in each case with a stop pin 3. For this purpose, the stop pin 3, which is substantially cylindrical overall, has an engagement groove 8 which is formed at least over part of its circumference and in which the correspondingly circularly curved region of interaction 7 engages once the pin has been pushed down, see, FIG. 8. This is because the retaining spring 6 is formed, and disposed, relative to the stop pins 3 such that the retaining spring 6 is basically pulled radially outwards in each case, with biasing, by the stop pins 3, which pass through the retaining spring in the regions of interaction 7. The interaction between the retaining spring 6 and a stop pin 3 in the region of interaction 7 is pronounced enough for the pushed-down latching position according to FIG. 8 to be maintained even counter to the action of the compression spring 5.

In order to release the activated position of a stop pin 3 according to FIG. 8, the stop part 2 has to be moved as a whole, to be precise in the direction counter to the direction in which the stop pin is pushed down, or in the plug-in direction of an introduced cable end. In the case of such a release movement, the abovementioned screw connection to the crimping tool 1 means that the central retaining pin 9 of the stop part 2 remains fixed. The housing 10 of the stop part 2 is thus moved relative to the pin 9, with the compression spring 11, which acts between the housing 10 and the stop pin 3, being compressed in the process. The compression spring 11 is a helical spring which encloses the stop pin 3 over part of its axial length.

During this movement, the retaining pin 9 passes through a central region of the retaining spring 6 in the region of an enlarged pin head 12. On account of the conical configuration of the pin head 12, this passing-through results in the retaining spring 6 being widened, since the pin head 12 acts in each case on the radially inner pin-action regions 13 of the retaining spring 6 and tries to force the same radially outwards.

Since, furthermore, the entire retaining spring 6 is accommodated in the housing 10, to which an upper housing part 14 also belongs, the radial movement of the retaining spring 6, and in particular of the regions of action 7, is limited, in the case of the exemplary embodiment, by a retaining wall 15. This results in a spreading-apart movement in the region of action 7, as a result of which the retaining force to which a stop pin 3 is subjected decreases to the extent where the compression spring 5 is stronger and forces the retaining pin 9 back into position according to FIG. 7, the non-activated position.

Since the stop part 2 as a whole is raised here relative to an outer surface of the crimping tool 1, with the exception of the central pin 9, it can also be rotated at the same time such that a further stop pin 3 ends up coinciding with the through-opening of the crimping tool. It can be seen that the interaction between the retaining pin 9 and the retaining spring 6 takes place in a radially offset manner, that is to say radially inward relative to the interaction between the retaining spring 6 and a stop pin 3.

As can also be seen from FIG. 6, the retaining spring 6 is formed in a single part. In principle, it can also be formed in more than one part.

The retaining spring, specifically, comprises a number of loop-like regions preferably corresponding to the number of stop pins 3. The loop-like regions are preferably formed radially inwardly, for the purpose of forming the region of interaction 7, with portions which are each in the form of portions of a circle and, as seen from the radially inward side, run concavely. These portions are preferably not continuous. Furthermore, they are preferably formed such that, if continued, they would form a closed line/closed circle. In addition, these portions preferably merge in the radially outward direction, in the corner regions, into legs. The legs preferably diverge slightly. The legs preferably merge into a radially outer curve portion which is in the form of a portion of a circle and forms the already mentioned region of action 7. The location where the preferably diverging legs merge into the radially outer curve region contains a preferably Y-shaped split which forms the connection to the neighboring spring element or neighboring loop-like region, this being done via a preferably outer curved path which more or less reproduces the radially outer circle in which the spring is disposed. Furthermore, the transition here is preferably formed in the manner of a loading-relief loop.

The concave inner curve portions preferably run along a line, further preferably a circular line, which is preferably adapted to the external dimension of the retaining pin 9, but, in order to achieve the effect described, is smaller than the external dimension of the retaining pin 9 in its head region, to which the latter widens on account of the conical part. On the other hand, the abovementioned circle or the abovementioned line is greater than the external diameter of the retaining pin 9, that is to say by the gauge of the compression spring 11, which, in the assembled state, still extends within the abovementioned circle.

With reference, in particular, to FIGS. 7 and 8, it can be seen that a stop pin 3 has, in its interior, a stop body 16 that can be displaced longitudinally to a limited extent in the stop pin 3, which, to the greatest extent, is internally cylindrical. In particular, the stop body 16 can give way in a resilient manner in the stop direction, that is to say in the direction of the gripping end of a stop pin 3, this gripping end being formed by the gripping part 21.

The stop body 16 itself is, in turn, internally hollow or configured with an accommodating opening, so that a wire end or the like can move into it. Furthermore, the stop body 16 has a cylindrical guide region 22, by way of which it is guided on the cylindrical inner surface of the stop pin 3. In the direction of the abovementioned gripping end, that is to say in the stop direction, this guide body 22 merges into a thinner neck region 23, which passes through a hole 24 that is smaller in diameter than the abovementioned cylinder region and is formed in the stop pin 3. This is followed by a, once again, somewhat larger-diameter region, a stop-body head 17. The radial projection of the stop-body head 17 beyond the neck region 23 forms a stop shoulder 19, by way of which the stop-body head is seated on the counter-stop 20, which features the hole 24 and is formed in the interior of the stop pin 3.

The abovementioned stop-body head 17 is subjected to the action of a spring part 18 which is in the form of a compression spring and, when not being influenced in any way, forces the stop body 16, by means of the stop-body head 17, against the abovementioned counter-stop 20 and thus defines the position in which the stop body 16 is displaced furthest in the direction away from the gripping end.

The spring part 18 is supported on the stop pin 3 itself, that is to say, in the case of the exemplary embodiment, by means of a gripping part 21, which forms the gripping end of the stop pin 3. The gripping part 21 is formed in the manner of a stopper, although, here too, it is a metal part. By means of a collar 25, it is situated on an end surface of the abovementioned cylindrical body which forms the stop pin 3. It projects slightly in the radial direction.

By means of a shank region 26, the gripping part 21 engages in the abovementioned cylindrical body which forms the stop pin 3.

All features disclosed are (in themselves) pertinent to the invention. The disclosure content of the associated/attached priority documents (copy of the prior application) is hereby also included in full in the disclosure of the application, also for the purpose of incorporating features of these documents in claims of the present application.

The invention claimed is:

1. Crimping tool (1) having crimp indentors and a through-opening for an introduction of a cable end which is to be crimped, introduction of the cable end being limited by an adjustable stop part (2) which is fixedly connected to the crimping tool (1), furthermore, the stop part (2) having different stop pins (3) which can be selectively activated by being pushed down and, if the different stop pin (3) is selected, an activated stop pin (3), which is biased into its non-activated position, having to be released from a stop position, wherein the activated stop pin (3) is retained by a spring latching means formed by a retaining spring (6), and the spring latching means is deactivated by a release movement of the stop part (2).

2. Crimping tool (1) according claim 1, wherein a stop pin (3) has a stop body (16), and wherein the stop body (16) is mounted such that it gives way in a resilient manner in a stop direction in the stop pin (3).

3. Crimping tool according to claim 1, wherein a release movement of the stop part (2) is effected in the direction in which the introduced cable end extends.

4. Crimping tool according to claim 1, wherein during a release movement, the stop part (2) is moved counter to spring biasing.

5. Crimping tool according to claim 1, wherein during a release movement, the retaining spring (6) is spread apart in order to deactivate the spring latching means.

6. Crimping tool according to claim 1, wherein the retaining spring (6) extends in a plane running transversely to a release movement.

7. Crimping tool according to claim 1, wherein a stop part (2) has a retaining pin (9) via which it is connected to the crimping tool, and wherein a spreading apart takes place by interaction between the retaining pin (9) and the retaining spring (6).

8. Crimping tool according to claim 1, wherein an interaction between the retaining pin (9) and the retaining spring (6) in the stop part (2) takes place in a radially offset manner in relation to the latching interaction between the retaining spring (6) and the activated stop pin (3).

9. Crimping tool according to claim 1, wherein the interaction with the retaining pin (9) is radially inward relative to the interaction with stop pin (3).

10. Crimping tool according to claim 1, wherein a single retaining spring (6) is provided for all stop pins (3) of the stop part (2).

11. Crimping tool according to claim 1, wherein the stop body (16) has a stop-body head (17), and wherein the stop-body head (17) interacts with a spring part (18).

12. Crimping tool according to claim 1, wherein the stop-body head (17) forms a stop shoulder (19) which interacts, in a direction counter to the stop direction, with a counter-stop (20) formed in the interior of stop pin (3).

13. Crimping tool according to claim 1, wherein stop pin (3) has a gripping end.

14. Crimping tool according to claim 1, wherein the gripping end is formed by a gripping part (21) held in stop pin (3).

15. Crimping tool according to claim 1, wherein said adjustable stop part is operationally releaseable.

* * * * *